US010683879B1

(12) United States Patent
Zähe

(10) Patent No.: US 10,683,879 B1
(45) Date of Patent: Jun. 16, 2020

(54) TWO-PORT ELECTROHYDRAULIC COUNTERBALANCE VALVE

(71) Applicant: Sun Hydraulics, LLC, Sarasota, FL (US)

(72) Inventor: Bernd Zähe, Sarasota, FL (US)

(73) Assignee: Sun Hydraulics, LLC, Sarasota, FL (US)

( * ) Notice: Subject to any disclaimer, the term of this patent is extended or adjusted under 35 U.S.C. 154(b) by 32 days.

(21) Appl. No.: 16/253,985

(22) Filed: Jan. 22, 2019

(51) Int. Cl.
*F15B 13/02* (2006.01)
*F15B 13/042* (2006.01)
*F15B 13/044* (2006.01)

(52) U.S. Cl.
CPC ..... *F15B 13/024* (2013.01); *F15B 13/025* (2013.01); *F15B 13/029* (2013.01); *F15B 13/0426* (2013.01); *F15B 13/0442* (2013.01); *Y10T 137/777* (2015.04); *Y10T 137/7766* (2015.04)

(58) Field of Classification Search
CPC .. F15B 13/0426; F15B 13/024; F15B 13/025; F15B 13/0442; Y10T 137/7766; Y10T 137/7769; Y10T 137/777
USPC ..... 137/491, 492, 492.5
See application file for complete search history.

(56) References Cited

U.S. PATENT DOCUMENTS 2,379,181 A 6/1945 Pontius et al.
2,575,272 A 11/1951 Harris
2,687,869 A 8/1954 Kanuch
3,033,228 A 5/1962 Forest
3,381,931 A 5/1968 Boonshaft et al.
4,289,160 A 9/1981 Kawasaki et al.
4,303,197 A 12/1981 Sandau
4,336,903 A 6/1982 Zirps
4,351,356 A 9/1982 Koiwai et al.
4,454,982 A 6/1984 Reick et al.
4,456,170 A 6/1984 Weigle et al.
(Continued)

FOREIGN PATENT DOCUMENTS

CN 105 952 702 9/2016
CN 108 843 645 11/2018

OTHER PUBLICATIONS

"Proportional Pressure Relief Valve Inverse Controlled Spool Type, Pilot-Operated Cartridge", dated Jan. 1, 2013.
(Continued)

*Primary Examiner* — William M McCalister
(74) *Attorney, Agent, or Firm* — McDonnell Boehnen Hulbert & Berghoff LLP

(57) ABSTRACT

An example valve includes: a main piston comprising: a channel that is fluidly coupled to a first port of the valve, a pilot seat, and one or more cross-holes fluidly coupled to a second port of the valve; a pilot check member configured to be subjected to a fluid force of fluid in the channel of the main piston acting on the pilot check member in a proximal direction; a solenoid actuator sleeve comprising a chamber; a first setting spring disposed in the chamber and configured to bias the solenoid actuator sleeve in a distal direction; and a second setting spring configured to bias the pilot check member in the distal direction, such that the first setting spring and the second setting spring cooperate to apply a biasing force in the distal direction on the pilot check member toward the pilot seat against the fluid force.

20 Claims, 7 Drawing Sheets

(56) References Cited

U.S. PATENT DOCUMENTS

| | | | | |
|---|---|---|---|---|
| 4,494,726 | A | 1/1985 | Kumar et al. | |
| 4,526,201 | A * | 7/1985 | Geyler, Jr. | F15B 13/0403 137/625.63 |
| 4,679,765 | A | 7/1987 | Kramer et al. | |
| 4,873,817 | A * | 10/1989 | Harms | A01D 41/141 56/10.2 F |
| 5,048,790 | A | 9/1991 | Wells | |
| 5,051,631 | A | 9/1991 | Anderson | |
| 5,144,881 | A | 9/1992 | Cakmaz | |
| 5,195,556 | A | 3/1993 | Fassbender | |
| 5,381,823 | A * | 1/1995 | DiBartolo | F16K 17/065 137/494 |
| 5,404,902 | A | 4/1995 | Wen | |
| 5,769,386 | A | 6/1998 | Sugiura et al. | |
| 5,836,335 | A | 11/1998 | Harms et al. | |
| 5,842,679 | A | 12/1998 | Kolchinsky | |
| 6,039,070 | A | 3/2000 | Zaehe | |
| 6,116,263 | A * | 9/2000 | Liberfarb | F15B 11/055 137/115.03 |
| 6,378,557 | B2 | 4/2002 | Kawamura et al. | |
| 6,390,441 | B2 | 5/2002 | Koyama et al. | |
| 6,805,155 | B2 | 10/2004 | Slawinski et al. | |
| 6,957,656 | B2 | 10/2005 | Tochiyama et al. | |
| 6,986,498 | B2 | 1/2006 | Hirota et al. | |
| 7,051,857 | B2 | 5/2006 | Babin | |
| 7,779,853 | B2 | 8/2010 | Reilly et al. | |
| 7,841,360 | B2 | 11/2010 | Bruck et al. | |
| 7,975,981 | B2 | 7/2011 | Harrison, Jr. | |
| 7,984,890 | B2 | 7/2011 | Pfaff et al. | |
| 8,375,981 | B2 | 2/2013 | Jeon | |
| 8,397,758 | B2 * | 3/2013 | Hillesheim | G05D 16/2024 137/625.68 |
| 8,733,391 | B2 | 5/2014 | Jeon | |
| 9,273,702 | B2 * | 3/2016 | Grawunde | F16K 17/065 |
| 9,322,416 | B2 * | 4/2016 | Bissbort | F15B 11/167 |
| 9,850,919 | B2 * | 12/2017 | Zaehe | F15B 13/015 |
| 10,437,269 | B1 * | 10/2019 | Zahe | F16K 17/044 |
| 2003/0106588 | A1 | 6/2003 | Zahe | |
| 2003/0131889 | A1 | 7/2003 | Kim | |
| 2005/0178443 | A1 | 8/2005 | Cheong | |
| 2005/0183775 | A1 | 8/2005 | Cheong | |
| 2006/0201554 | A1 | 9/2006 | Prinsen et al. | |
| 2006/0266419 | A1 | 11/2006 | Krug-Kussius | |
| 2009/0050222 | A1 | 2/2009 | Jackson et al. | |
| 2010/0294380 | A1 | 11/2010 | Nagata et al. | |
| 2011/0139260 | A1 | 6/2011 | Dornbach et al. | |
| 2012/0305108 | A1 * | 12/2012 | Jerchen | F16K 17/105 137/488 |
| 2016/0091101 | A1 * | 3/2016 | Neubauer | F16K 11/0655 137/625.18 |
| 2017/0328380 | A1 | 11/2017 | Coolidge et al. | |

OTHER PUBLICATIONS

International Search Report and Written Opinion prepared by the European Patent Office in International Application No. PCT/US2019/065648 dated Mar. 18, 2020.

* cited by examiner

TWO-PORT ELECTROHYDRAULIC COUNTERBALANCE VALVE

BACKGROUND

Counterbalance valves are hydraulic valves configured to hold and control negative or gravitational loads. They may be configured to operate, for example, in applications that involve the control of suspended loads, such as mechanical joints, lifting applications, extensible movable bridge, winches, etc.

In some applications, the counterbalance valve, which may also be referred to as an overcenter valve, could be used as a safety device that prevents an actuator from moving if a failure occurs (e.g., a hose burst) or could be used as a load-holding valve (e.g., on a boom cylinder of a mobile machinery). The counterbalance valve allows cavitation-free load lowering, preventing the actuator from overrunning when pulled by the load (gravitational load).

A counterbalance valve can introduces instability in a hydraulic system due to oscillations of a movable element within the counterbalance valve. It may thus be desirable to have a counterbalance valve that enhances stability in the hydraulic system.

SUMMARY

The present disclosure describes implementations that relate to a two-port electrohydraulic counterbalance valve.

In a first example implementation, the present disclosure describes a valve. The valve includes: (i) a main piston comprising: (a) a channel that is fluidly coupled to a first port of the valve, (b) a pilot seat, and (c) one or more cross-holes fluidly coupled to a second port of the valve; (ii) a reverse flow piston disposed at the first port of the valve and configured to move axially within the valve; (iii) a reverse flow check spring that biases the reverse flow piston toward the main piston, such that the reverse flow piston operates as a piston seat for the main piston when the valve is closed; (iv) a pilot check member configured to be seated at the pilot seat when the valve is closed to block fluid flow from the channel to the one or more cross-holes of the main piston, wherein the pilot check member is configured to be subjected to a fluid force of fluid in the channel of the main piston acting on the pilot check member in a proximal direction; (v) a solenoid actuator sleeve comprising a chamber therein; (vi) a first setting spring disposed in the chamber within the solenoid actuator sleeve and configured to bias the solenoid actuator sleeve in a distal direction; and (vii) a second setting spring disposed about an exterior peripheral surface of the solenoid actuator sleeve and configured to bias the pilot check member in the distal direction, such that the first setting spring and the second setting spring cooperate to apply a biasing force in the distal direction on the pilot check member toward the pilot seat against the fluid force.

In a second example implementation, the present disclosure describes a hydraulic system including a tank; a hydraulic actuator having a chamber therein; and a valve having a first port fluidly coupled to the chamber of the hydraulic actuator, and a second port configured to be fluidly coupled to the tank. The valve includes: (i) a main piston comprising: (a) a channel that is fluidly coupled to the first port of the valve, (b) a pilot seat, and (c) one or more cross-holes fluidly coupled to the second port of the valve; (ii) a reverse flow piston disposed at the first port of the valve and configured to move axially within the valve; (iii) a reverse flow check spring that biases the reverse flow piston toward the main piston, such that the reverse flow piston operates as a piston seat for the main piston when the valve is closed; (iv) a pilot check member configured to be seated at the pilot seat when the valve is closed to block fluid flow from the channel to the one or more cross-holes of the main piston, wherein the pilot check member is configured to be subjected to a fluid force of fluid in the channel of the main piston acting on the pilot check member in a proximal direction; (v) a solenoid actuator sleeve; (vi) a first setting spring disposed within the solenoid actuator sleeve and configured to bias the solenoid actuator sleeve in a distal direction; and (vii) a second setting spring disposed about an exterior peripheral surface of the solenoid actuator sleeve and configured to bias the pilot check member in the distal direction, such that the first setting spring and the second setting spring cooperate to apply a biasing force in the distal direction on the pilot check member toward the pilot seat against the fluid force.

In a third example implementation, the present disclosure describes a method. The method includes: (i) operating a valve at a first pressure setting, wherein a first setting spring disposed within a solenoid actuator sleeve and a second setting spring disposed about an exterior peripheral surface of the solenoid actuator sleeve apply a biasing force to a pilot check member to cause the pilot check member to be seated at a pilot seat formed by a main piston, thereby blocking a pilot flow path through the valve and blocking fluid at a first port of the valve until pressure level of fluid at the first port exceeds the first pressure setting; (ii) receiving an electric signal energizing a solenoid coil of a solenoid actuator of the valve; (iii) responsively, causing an armature coupled to the solenoid actuator sleeve to move, thereby compressing the first setting spring and decompressing the second setting spring, causing the biasing force to be reduced, and operating the valve at a second pressure setting that is less than the first pressure setting; (iv) receiving, at the first port of the valve, pressurized fluid having a particular pressure level that exceeds the second pressure setting such that the pressurized fluid overcomes the biasing force, thereby causing the pilot check member to be unseated and opening the pilot flow path to allow pilot flow from the first port to a second port of the valve; and (v) in response to pilot flow through the pilot flow path, causing the main piston to move, thereby allowing main flow from the first port to the second port.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

Figure 1:
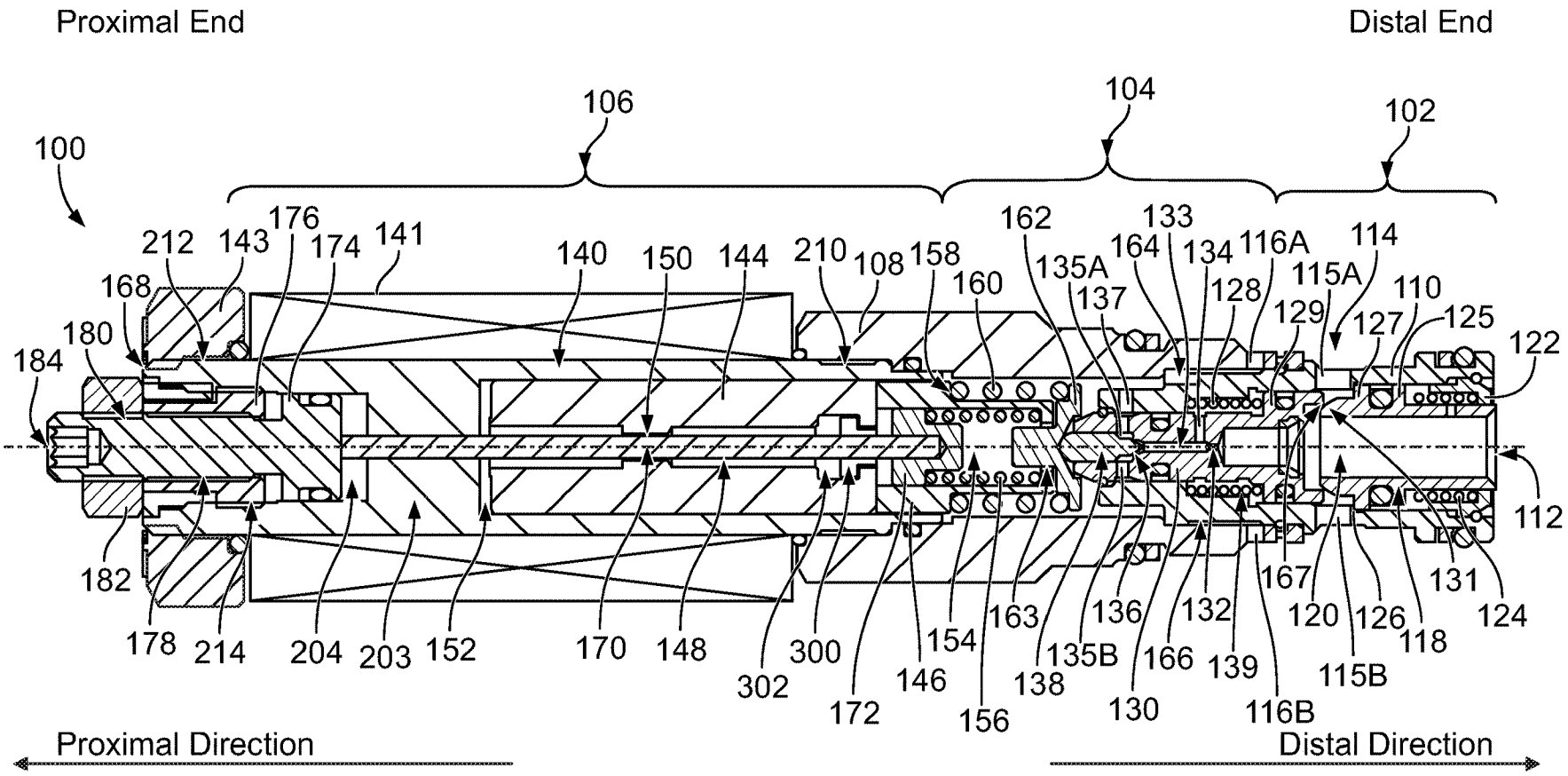
FIG. 1 illustrates a cross-sectional side view of a valve, in accordance with an example implementation.

In examples, a pilot-operated counterbalance valve can be used on the return side of a hydraulic actuator for lowering a large negative load in a controlled manner. The counterbalance valve generates a preload or back-pressure in the return line that acts against the main drive pressure so as to maintain a positive load, which therefore remains controllable. Particularly, if a speed of the actuator increases, pressure on one side of the actuator may drop and the counterbalance valve may then act to restrict the flow to controllably lower the load.

An example pilot-operated counterbalance valve can have three ports: a port fluidly coupled to a first side of the actuator (e.g., rod side of a hydraulic actuator cylinder), a second port operating as an outlet port that is fluidly coupled to a tank, and a third port that can be referred to as a pilot port. The pilot port can be fluidly coupled via a pilot line to a supply line connected to a second side of the actuator (e.g., head side of the hydraulic actuator cylinder).

The counterbalance valve can have a spring that acts against a movable element (e.g., a spool or a poppet), and the force of the spring determines a pressure setting of the counterbalance valve. The pressure setting is the pressure level of fluid at the first port of the counterbalance valve that can cause the counterbalance valve to open.

The back-pressure in the first side of the actuator cooperates with a pilot signal provided via the pilot line to open the counterbalance valve. The counterbalance valve can be characterized by a ratio between a first surface area on which the pilot signal acts and a second surface area on which the pressure induced in the first side of the actuator acts within the counterbalance valve. Such ratio may be referred to as "pilot ratio."

The pilot signal effectively reduces the pressure setting of the counterbalance valve. The extent of reduction in the pressure setting is determined by the pilot ratio. For example, if the pilot ratio is 3 to 1 (3:1), then for each 10 bar increase in pressure level of the pilot signal, the pressure setting of the setting spring is reduced by 30 bar. As another example, if the pilot ratio is 8 to 1 (8:1), then for each 10 bar increase in the pressure level of pilot signal, the pressure setting of the setting spring is reduced by 80 bar.

Under some operating conditions, a counterbalance valve can introduce instability in a hydraulic system due to oscillations of a movable element within the counterbalance valve. The pilot ratio affects stability of the hydraulic system. If a counterbalance valve is chosen for a particular hydraulic system and the pilot ratio is not selected correctly for the hydraulic system, the counterbalance valve can introduce instabilities in the hydraulic system. It may thus be desirable to have a counterbalance valve that enhances stability in the hydraulic system.

Further, in examples, the counterbalance valve can be configured to have a pressure setting that is higher (e.g., 30% higher) than an expected maximum induced pressure in an actuator controlled by the counterbalance valve. However, this configuration may render operation of the counterbalance valve energy inefficient. Particularly, the expected maximum induced pressure might not occur in all working conditions, and configuring the counterbalance valve to handle the expected maximum induced pressure may cause a large amount of energy loss.

For instance, an actuator may operate a particular tool that experiences a high load in some cases; however, the actuator may operate another tool that experiences small load in other cases. In the cases where the actuator operates a tool that experiences a small load, having the counterbalance valve with a high pressure setting renders the hydraulic system inefficient. Particularly, in these cases, the hydraulic system provides a pilot signal having a high pressure level to open the counterbalance valve, and the counterbalance generates a large backpressure thereby causing the system to consume an extra amount of power or energy that could have been avoided if the counterbalance valve has a lower pressure setting.

As another example, an actuator of a mobile machinery may be coupled to the machine at a hinge and as the actuator rotates about the hinge the kinematics of the actuator change, and the load may increase or decrease based on the rotational position of the actuator. In some rotational positions, the load may be large causing a high induced pressure, but in other rotational positions the load may be small causing a low induced pressure.

Configuring the counterbalance valve to handle the large load and high induced pressure renders operation of the hydraulic system inefficient when the load is small. Due to the high pressure setting of the counterbalance valve, a pilot signal having a high pressure level is provided to open the counterbalance valve and a large backpressure is generated, whereas for the small load a pilot signal having a low pressure level could have been used. The increased pressure level multiplied by flow to the actuator results in energy loss that could have been avoided if the pressure setting of the counterbalance valve is lowered based on conditions of the hydraulic system.

Therefore, it may be desirable to have a counterbalance valve with a pressure setting that could be varied during operation of the hydraulic system. Such variation could render the hydraulic system more efficient.

Disclosed herein is a counterbalance valve that has two ports, rather than three ports. Particularly, the disclosed counterbalance valve does not comprise a pilot port. Rather, the disclosed counterbalance valve has a pressure setting that can be changed by an actuation signal (e.g., with an electrical signal) to a solenoid coil. By avoiding the use of a pilot port and a pilot signal to open the counterbalance valve, stability of the counterbalance valve and the hydraulic system can be enhanced.

Further, by being able to change the pressure setting of the counterbalance valve via an electrical signal, the counterbalance valve can be adapted dynamically to the varying loads and conditions of the hydraulic system. As such, the hydraulic system can be operated more efficiently.

The disclosed counterbalance valve further includes a pilot stage that is decoupled from a solenoid actuator so as to enhance valve resolution and stability. The counterbalance valve can further include a manual adjustment actuator to change a maximum pressure setting of the counterbalance valve.

FIG. 1 illustrates a cross-sectional side view of a valve 100, in accordance with an example implementation. The valve 100 may be inserted or screwed into a manifold having ports corresponding to ports of the valve 100 described below, and can thus fluidly coupled the valve 100 to other components of a hydraulic system.

The valve 100 includes a main stage 102, a pilot stage 104, and a solenoid actuator 106. The valve 100 includes a housing 108 that includes a longitudinal cylindrical cavity therein. The longitudinal cylindrical cavity of the housing 108 is configured to house portions of the main stage 102, the pilot stage 104, and the solenoid actuator 106.

The main stage 102 includes a main sleeve 110 received at a distal end of the housing 108, and the main sleeve 110 is coaxial with the housing 108. The valve 100 includes a first port 112 and a second port 114. The first port 112 can also be referred to as a load port and is configured to be fluidly coupled to a chamber of a hydraulic actuator. The second port 114 can be fluidly coupled to a tank directly or through a directional control valve.

The first port 112 is defined at a nose or distal end of the main sleeve 110. The second port 114 can include a first set of cross-holes that can be referred to as main flow cross-holes, such as main flow cross-holes 115A, 115B, disposed in a radial array about the main sleeve 110. The second port 114 can also include a second set of cross-holes that can be referred to as pilot flow cross-holes, such as pilot flow cross-holes 116A, 116B disposed in the housing 108.

The main sleeve 110 includes a respective longitudinal cylindrical cavity therein. The valve 100 includes a reverse flow piston 118 that is disposed, and slidably accommodated, in the longitudinal cylindrical cavity of the main sleeve 110. The reverse flow piston 118 is referred to as a "reverse flow" piston because it is configured to allow fluid flow from the second port 114 to the first port 112 as described below with respect to FIG. 5. The term "piston" is used herein to encompass any type of movable element, such as a spool-type movable element or a poppet-type movable element.

Further, the term "slidably accommodated" is used throughout herein to indicate that a first component (e.g., the reverse flow piston 118) is positioned relative to a second component (e.g., the main sleeve 110) with sufficient clearance therebetween, enabling movement of the first component relative to the second component in the proximal and distal directions. As such, the first component (e.g., reverse flow piston 118) is not stationary, locked, or fixedly disposed in the valve 100, but rather, is allowed to move relative to the second component (e.g., the main sleeve 110).

A main chamber 120 is formed within the main sleeve 110, and the reverse flow piston 118 is hollow such that interior space of the reverse flow piston 118 is comprised in the main chamber 120. The main chamber 120 is fluidly coupled to the first port 112. The valve 100 includes a ring-shaped member 122 fixedly disposed, at least partially, within the main sleeve 110 at a distal end thereof. The valve 100 also includes a reverse flow check spring 124 disposed about an exterior peripheral surface of the reverse flow piston 118.

The ring-shaped member 122 protrudes radially inward within the cavity of the main sleeve 110 to form a support for a distal end of the reverse flow check spring 124. A proximal end of the reverse flow check spring 124 acts against a shoulder 125 projecting radially outward from the reverse flow piston 118. With this configuration, the distal end of the reverse flow check spring 124 is fixed, whereas the proximal end of the reverse flow check spring 124 is movable and interfaces with the reverse flow piston 118. Thus, the reverse flow check spring 124 biases the reverse flow piston 118 in a proximal direction (e.g., to the left in FIG. 1). Further, the main sleeve 110 includes a protrusion 126 that interfaces with a shoulder 127 of the reverse flow piston 118 to preclude the reverse flow piston 118 from moving in the proximal direction beyond the protrusion 126.

The valve 100 further includes a main piston 130 disposed, and slidably accommodated, in the cavity of the main sleeve 110. In other words, the main piston 130 is axially or longitudinally movable within the main sleeve 110. As depicted in FIG. 1, the main chamber 120 comprises a portion of the interior space of the main piston 130 as well as the interior space of the reverse flow piston 118.

The valve 100 further includes a spring 128 disposed about an exterior peripheral surface of the main piston 130. Particularly, the spring 128 is disposed in an annular chamber 139 formed between the interior peripheral surface of the main sleeve 110 and the exterior peripheral surface of the main piston 130. The spring 128 has a proximal end resting against a shoulder formed by the interior peripheral surface of the main sleeve 110 and a distal end that rests against a shoulder 129 projecting radially outward from the main piston 130. With this configuration, the spring 128 biases the main piston 130 in the distal direction toward the reverse flow piston 118. A tapered exterior peripheral surface of the reverse flow piston 118 at a proximal end thereof forms a piston seat 131 for the main piston 130. In a closed position, the main piston 130 is biased by the spring 128 to be seated on the piston seat 131 to block fluid flow from the first port 112 to the second port 114. The term "block" is used throughout herein to indicate substantially preventing fluid flow except for minimal or leakage flow of drops per minute, for example. Also, the "closed position" indicates a state of the valve 100 wherein fluid is blocked from flowing from the first port 112 to the second port 114.

The main piston 130 has an orifice 132, a longitudinal channel 133, and a radial channel 134. The orifice 132 fluidly couples the main chamber 120 to the longitudinal channel 133, and the radial channel 134 fluidly couples the longitudinal channel 133 to the annular chamber 139 that houses the spring 128. The main piston 130 further includes radial cross-holes disposed in a radial array about the main piston 130, such as radial cross-holes 135A, 135B. The radial cross-holes 135A, 135B are fluidly coupled to a cross-hole 137 formed in the main sleeve 110.

The main piston 130 forms a pilot seat 136 therein. Particularly, an interior surface of the main piston 130 forms the pilot seat 136 at a proximal end of the longitudinal channel 133. The valve 100 further includes a pilot check member 138 (e.g., a pilot poppet) configured to be seated at the pilot seat 136 when the valve 100 is closed, thereby blocking fluid communication from the longitudinal channel 133 to the radial cross-holes 135A, 135B. In particular, with the configuration shown in FIG. 1, the pilot check member 138 is configured as a poppet having a nose section that tapers gradually, such that an exterior surface of the nose section of the poppet is seated at the pilot seat 136 to block fluid flow when the valve 100 is closed.

As shown in FIG. 1, the pilot check member 138 is disposed, at least partially, within the main piston 130 and is slidably accommodated therein. The pilot check member 138 is thus guided by an interior peripheral surface of the main piston 130 when the pilot check member 138 moves axially in a longitudinal direction.

The solenoid actuator 106 includes a solenoid tube 140 configured as a cylindrical housing or body disposed within and received at a proximal end of the housing 108, such that the solenoid tube 140 is coaxial with the housing 108. A solenoid coil 141 can be disposed about an exterior surface of the solenoid tube 140. The solenoid coil 141 is retained between a proximal end of the housing 108 and a coil nut 143 having internal threads that can engage a threaded region formed on the exterior peripheral surface of the solenoid tube 140 at its proximal end.

Figure 2:
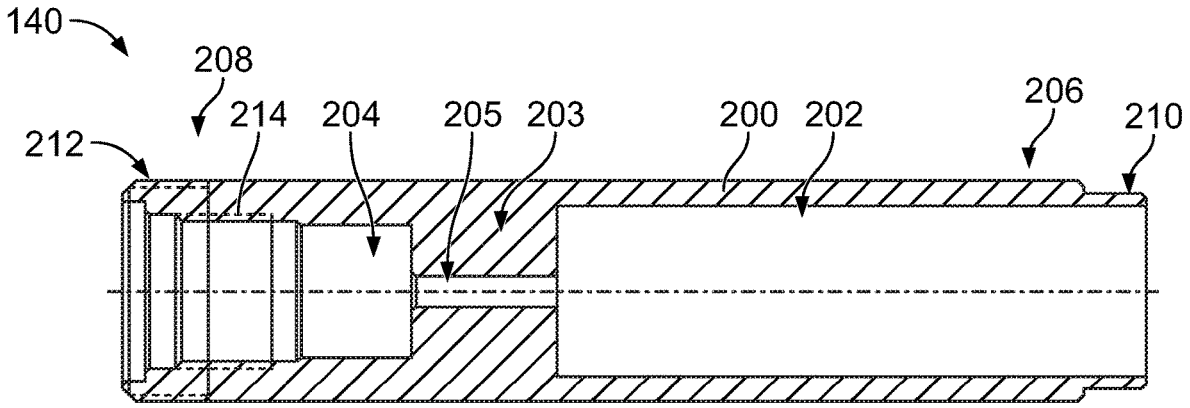
FIG. 2 illustrates a cross-sectional side view of a solenoid tube, in accordance with an example implementation.

FIG. 2 illustrates a cross-sectional side view of the solenoid tube 140, in accordance with an example implementation. As depicted, the solenoid tube 140 has a cylindrical body 200 having therein a first chamber 202 within a distal side of the cylindrical body 200 and a second chamber 204 within a proximal side of the cylindrical body 200. The solenoid tube 140 includes a pole piece 203 formed as a protrusion within the cylindrical body 200. The pole piece 203 separates the first chamber 202 from the second chamber 204. In other words, the pole piece 203 divides a hollow interior of the cylindrical body 200 into the first chamber 202 and the second chamber 204. The pole piece 203 can be composed of material of high magnetic permeability.

Further, the pole piece 203 defines a channel 205 therethrough. In other words, an interior peripheral surface of the solenoid tube 140 at or through the pole piece 203 forms the channel 205, which fluidly couples the first chamber 202 to the second chamber 204. As such, pressurized fluid provided to the first chamber 202 is communicated through the channel 205 to the second chamber 204.

In examples, the channel 205 can be configured to receive a pin therethrough so as to transfer linear motion of one component in the second chamber 204 to another component in the first chamber 202 and vice versa, as described below. As such, the channel 205 can include chamfered circumferential surfaces at its ends (e.g., an end leading into the first chamber 202 and another end leading into the second chamber 204) to facilitate insertion of such a pin therethrough.

The solenoid tube 140 has a distal end 206, which is configured to be coupled to the housing 108, and a proximal end 208. Particularly, the solenoid tube 140 can have a first threaded region 210 disposed on an exterior peripheral surface of the cylindrical body 200 at the distal end 206 that is configured to threadedly engage with corresponding threads formed in the interior peripheral surface of the housing 108.

Also, the solenoid tube 140 can have a second threaded region 212 disposed on the exterior peripheral surface of the cylindrical body 200 at the proximal end 208 and configured to be threadedly engaged with corresponding threads formed in the interior peripheral surface of the coil nut 143. Further, the solenoid tube 140 can have a third threaded region 214 disposed on an interior peripheral surface of the cylindrical body 200 at the proximal end 208 and configured to threadedly engage with corresponding threads formed in a component of a manual adjustment actuator 168 as described below (see FIG. 1). The solenoid tube 140 can also have one or more shoulders formed in the interior peripheral surface of the cylindrical body 200 that can mate with respective shoulders of the manual adjustment actuator 168 to enable alignment of the manual adjustment actuator 168 within the solenoid tube 140.

Referring back to FIG. 1, the solenoid tube 140 is configured to house an armature 144 in the first chamber 202. The armature 144 is slidably accommodated within the solenoid tube 140 (i.e., the armature 144 can move axially within the solenoid tube 140).

The solenoid actuator 106 further includes a solenoid actuator sleeve 146 received at the proximal end of the housing 108 and also disposed partially within a distal end of the solenoid tube 140. The armature 144 is mechanically coupled to, or linked with, the solenoid actuator sleeve 146. As such, if the armature 144 moves axially (e.g., in the proximal direction), the solenoid actuator sleeve 146 moves along with the armature 144 in the same direction.

Figure 3:
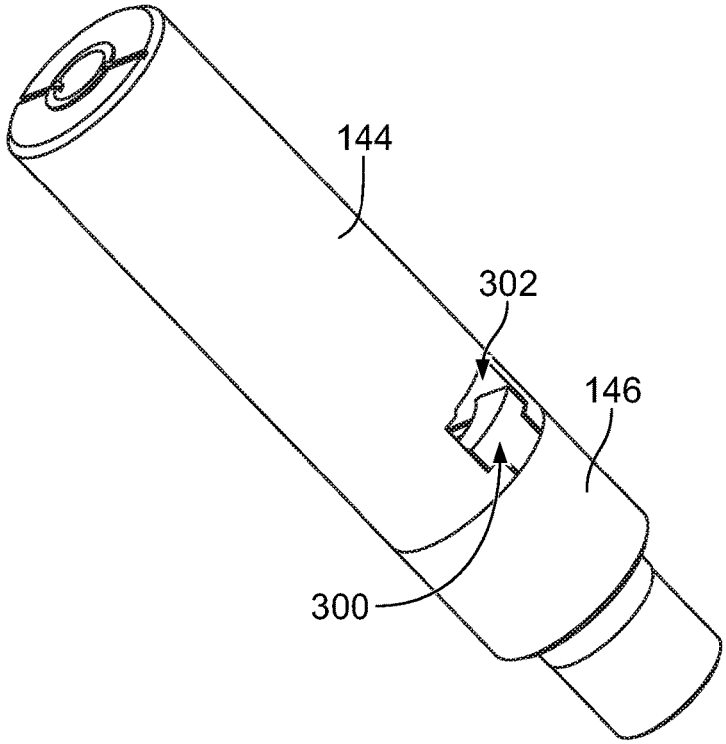
FIG. 3 illustrates a three-dimensional partial perspective view showing an armature coupled to a solenoid actuator sleeve, in accordance with another example implementation.

The armature 144 can be coupled to the solenoid actuator sleeve 146 in several ways. FIG. 3 illustrates a three-dimensional partial perspective view showing the armature 144 coupled to the solenoid actuator sleeve 146, in accordance with an example implementation. As shown, the solenoid actuator sleeve 146 can have a male T-shaped member 300, and the armature 144 can have a corresponding female T-slot 302 formed as an annular internal groove configured to receive the male T-shaped member 300 of the solenoid actuator sleeve 146. With this configuration, the armature 144 and the solenoid actuator sleeve 146 are coupled to each other, such that if the armature 144 moves, the solenoid actuator sleeve 146 moves therewith.

Referring back to FIG. 1, the armature 144 includes a longitudinal channel 148 formed therein. The armature 144 further includes a protrusion 150 within the longitudinal channel 148 that can be configured to guide linear motion of a pin (e.g., pin 170 described below).

As mentioned above, the solenoid tube 140 includes the pole piece 203 formed as a protrusion within the cylindrical body 200. The pole piece 203 is separated from the armature 144 by the airgap 152.

The solenoid actuator sleeve 146 forms therein a chamber 154 configured to house a first setting spring 156. The first setting spring 156 is thus disposed within the solenoid actuator sleeve 146 and can interface with an interior peripheral surface of the solenoid actuator sleeve 146. Further, the solenoid actuator sleeve 146 has a distal section having a first outer diameter and a proximal section having a second outer diameter larger than the first outer diameter such that the solenoid actuator sleeve 146 forms a shoulder 158 at the transition between the distal section and the proximal section.

The valve 100 further includes a second setting spring 160 disposed about an exterior peripheral surface of the solenoid actuator sleeve 146. A proximal end of the second setting spring 160 rests against the shoulder 158 of the solenoid actuator sleeve 146, whereas a distal end of the second setting spring 160 rests against a pilot spring cap 162 disposed between the solenoid actuator sleeve 146 and the pilot check member 138.

As depicted in FIG. 1, the pilot spring cap 162 interfaces with and contacts a proximal end of the pilot check member 138. Further, the pilot spring cap 162 is received at a distal end of the solenoid actuator sleeve 146 through a hole 163 in the solenoid actuator sleeve 146, and thus the pilot spring cap 162 and the solenoid actuator sleeve 146 can slide or move axially relative to each other.

The first setting spring 156 can have a first spring constant or spring rate $k_1$, and the first setting spring 156 applies a biasing force on the solenoid actuator sleeve 146 in the distal direction. Similarly, the second setting spring 160 can have a second spring rate $k_2$, and the second setting spring 160 applies a biasing force in the distal direction on the pilot spring cap 162 and the pilot check member 138 interfacing therewith.

With the configuration of the valve 100 shown in FIG. 1, the first setting spring 156 and the second setting spring 160 are disposed in series with respect to the pilot spring cap 162 and the pilot check member 138. Particularly, any force applied to the pilot check member 138 is applied to each setting spring 156, 160 without change of magnitude, and the amount of strain (deformation) or axial motion of the pilot check member 138 is the sum of the strains of the individual setting springs 156, 160.

As such, the combination of the first setting spring 156 and the second setting spring 160 has an equivalent or effective spring rate $k_{eq}$ that is less than the respective spring rate of either spring. Particularly, the effective spring rate $k_{eq}$ can be determined as $$\frac{k_1 k_2}{k_1 + k_2}.$$

The effective spring rate $k_{eq}$ determines a magnitude of a biasing force applied on the pilot check member 138 in the distal direction by way of the combined action of the setting springs 156, 160. In other words, the first setting spring 156 and the second setting spring 160 cooperate to apply a biasing force on the pilot check member 138 in the distal direction. Such biasing force determines the pressure setting of the valve 100, where the pressure setting is the pressure level of fluid at the first port 112 at which the valve 100 can open to provide fluid to the second port 114.

Specifically, based on the equivalent spring rate $k_{eq}$ of the setting springs 156, 160 and their respective lengths, the setting springs 156, 160 exert a particular preload or biasing force on the pilot spring cap 162 and pilot check member 138 in the distal direction, thus causing the pilot check member 138 to be seated at the pilot seat 136 of the main piston 130. The pressure setting of the valve 100 can be determined by dividing the biasing force that the setting springs 156, 160 apply to the pilot check member 138 by an effective area of the pilot seat 136. The effective area of the pilot seat 136 can be estimated as a circular area having a diameter of the pilot seat 136, which can be slightly larger than the diameter the longitudinal channel 133. As an example for illustration, if the diameter of the pilot seat 136 is about 0.042 inch and the biasing force is about 4.2 pounds, then the pressure setting of the valve 100 can be about 3000 pounds per square inch (psi).

As shown in FIG. 1, the main sleeve 110 includes a plurality of longitudinal channels or longitudinal through-holes such as longitudinal through-hole 164. Further, the longitudinal through-hole 164 is fluidly coupled to the pilot flow cross-holes 116A, 116B of the housing 108 via an annular undercut or annular groove 166 formed on the exterior peripheral surface of the main sleeve 110.

In operation, the fluid at the first port 112 is communicated through the main chamber 120 to a distal end of the main piston 130 and applies a force on the main piston 130 in the proximal direction. The fluid at the first port 112 is also communicated through the main chamber 120, the orifice 132, the longitudinal channel 133, and the radial channel 134 fluid to the annular chamber 139 that houses the spring 128 and applies a force along with the spring 128 on the main piston 130 in the distal direction toward the piston seat 131. When no fluid flow occurs through the orifice 132 (i.e., when the pilot check member 138 remains seated at the pilot seat 136), the pressure level of fluid in the main chamber 120 is the same as the pressure level of fluid in the annular chamber 139 housing the spring 128. In this case, the combined forces of the spring 128 and the fluid acting on the main piston 130 in the distal direction can be higher than the fluid force acting on the main piston 130 in the proximal direction, thereby causing the main piston 130 to be seated at the piston seat 131.

The fluid at the first port 112 is also communicated to the pilot check member 138 through the main chamber 120, the orifice 132, and the longitudinal channel 133. The fluid applies a fluid force on the pilot check member 138 in the proximal direction. When pressure level of the fluid at the first port 112, which is communicated to the pilot check member 138, reaches or exceeds the pressure setting determined by the setting springs 156, 160, the fluid force overcomes a biasing force of the setting springs 156, 160 on the pilot check member 138. The fluid thus pushes the pilot check member 138 in the proximal direction (to the left in FIG. 1) off the pilot seat 136. As mentioned above, the pressure setting is determined by dividing a preload force that the setting springs 156, 160 apply to the pilot check member 138 (via the pilot spring cap 162) by the effective area of the pilot seat 136 (e.g., the circular area having the diameter of the pilot seat 136). As an example for illustration, the pilot check member 138 can move a distance of about 0.05 inches off the pilot seat 136.

As a result of the pilot check member 138 being unseated, a pilot flow path is formed and pilot fluid flow is generated from the first port 112 to the second port 114. Particularly, fluid at the first port 112 can flow through the main chamber 120, the orifice 132, the longitudinal channel 133, then around the nose of the pilot check member 138 (now unseated), through the radial cross-holes 135A, 135B, the cross-hole 137, the longitudinal through-hole 164, the annular groove 166, and the pilot flow cross-holes 116A, 116B to the second port 114. Such fluid flow from the first port 112 to the second port 114 through the pilot flow cross-holes 116A, 116B can be referred to as the pilot flow. As an example for illustration, the pilot flow can amount to about 0.15 gallons per minute (GPM).

The pilot flow through the orifice 132, which operates as a flow restriction, causes a pressure drop in the pressure level of the fluid. For example, if pressure level of fluid at the first port 112 and the main chamber 120 is about 3200 psi, pressure level in the longitudinal channel 133 and the annular chamber 139 can be about 3000 psi.

Thus, the pressure level of fluid in the main chamber 120 becomes higher than the pressure level of fluid in the annular chamber 139. As a result, fluid at the first port 112 applies a force on the distal end of the main piston 130 in the proximal direction (e.g., to the left in FIG. 1) that is larger than the force applied by fluid in annular chamber 139 on the main piston 130 in the distal direction (e.g., to the right in FIG. 1).

Due to the imbalance of forces acting on the main piston 130, a net force is applied to the main piston 130 in the proximal direction. When the net force overcomes the biasing force of the spring 128 on the main piston 130, the net force causes the main piston 130 to move or be displaced axially in the proximal direction against the biasing force of the spring 128. The spring 128 can be configured as a weak spring, e.g., a spring with a spring rate of 9 pound-force/inch (lbf/in) causing a 4 pound-force (lbf) biasing force on the reverse flow piston 118. With such a low spring rate, a low pressure level differential (or pressure drop) across the orifice 132, e.g., pressure level differential of 25 psi, can cause the main piston 130 to move in the proximal direction against the biasing force of the spring 128.

Axial movement of the main piston 130 in the proximal direction off the piston seat 131 causes a flow area 167 between the main piston 130 and the reverse flow piston 118, and a main flow path is formed to allow fluid flow from the first port 112 to the second port 114. Particularly, fluid is thus allowed to flow from the first port 112 through the main chamber 120, the flow area 167, and the main flow cross-holes 115A, 115B to the second port 114. Such direct flow from the first port 112 to the second port 114 can be referred to as the main flow. As an example for illustration, the main flow rate can amount to up to 25 GPM based on the pressure setting of the valve 100 and the pressure drop between the first port 112 and the second port 114. The 25 GPM main flow rate is an example for illustration only. The valve 100 is scalable in size and different amounts of main flow rates can be achieved.

The second port 114 can be coupled (directly or through a directional control valve) to a low pressure reservoir or tank having fluid at low pressure level (e.g., atmospheric or low pressure level such as 10-70 psi). As such, when pressure level at the first port 112 reaches the pressure setting of the valve 100, the valve 100 opens the main flow path and pressurized fluid is provided from the first port 112 (the load port) to the tank through the second port 114.

In some applications, it may be desirable to have a manual adjustment actuator coupled to the valve 100 so as to allow for manual modification of the preload of the setting springs 156, 160, while the valve 100 is installed in the hydraulic system without disassembling the valve 100. Modification of the preload of the setting springs 156, 160 causes modification of the pressure setting of the valve 100.

FIG. 1 illustrates the valve 100 having a manual adjustment actuator 168. The manual adjustment actuator 168 is configured to allow for adjusting a maximum pressure setting of the valve 100 without disassembling the valve 100. The manual adjustment actuator 168 includes a pin 170 disposed through the channel 205 and the longitudinal channel 148. The pin 170 is coupled to a spring cap 172 that interfaces with the first setting spring 156 of the valve 100. With this configuration, the spring cap 172 is movable via the pin 170 and can adjust the length of the first setting spring 156.

The manual adjustment actuator 168 includes an adjustment piston 174 that interfaces with or contacts the pin 170, such that longitudinal or axial motion of the adjustment piston 174 causes the pin 170 and the spring cap 172 coupled thereto to move axially therewith. The adjustment piston 174 can be threadedly coupled to a nut 176 at threaded region 178. The nut 176 in turn is threadedly coupled to the solenoid tube 140 at the threaded region 214. As such, the adjustment piston 174 is coupled to the solenoid tube 140 via the nut 176. Further, the adjustment piston 174 is threadedly coupled at threaded region 180 to another nut 182.

The adjustment piston 174 is axially movable within the second chamber 204 of the solenoid tube 140. For instance, the adjustment piston 174 can include an adjustment screw 184, such that if the adjustment screw 184 is rotated in a first rotational direction (e.g., clockwise) the adjustment piston 174 moves in the distal direction (e.g., to the right in FIG. 1) by engaging more threads of the threaded regions 178, 180. If the adjustment screw 184 is rotated in a second rotational direction (e.g., counter-clockwise) the adjustment piston 174 is allowed to move in the proximal direction (e.g., to the left in FIG. 1) by disengaging some threads of the threaded regions 178, 180.

While the distal end of the first setting spring 156 is coupled to or rests against a distal interior surface of the solenoid actuator sleeve 146, the proximal end of the first setting spring 156 rests against the spring cap 172, which is coupled to the adjustment piston 174 via the pin 170. As such, axial motion of the adjustment piston 174 results in a change in the length of the first setting spring 156.

Due to compression of the first setting spring 156, the force it applies on the solenoid actuator sleeve 146 can increase to a particular force magnitude that can overcome friction forces acting on the solenoid actuator sleeve 146 and the armature 144 coupled thereto. As a result, the solenoid actuator sleeve 146 and the armature 144 coupled thereto can move axially in the distal direction, and the solenoid actuator sleeve 146 compresses the second setting spring 160 against the pilot spring cap 162.

As the setting springs 156, 160 are compressed, the biasing force applied to the pilot spring cap 162 and the pilot check member 138 increases. Further compression of the setting springs 156, 160 results in a larger biasing force on the pilot check member 138, thereby increasing the pressure setting of the valve 100, i.e., increasing the pressure level of fluid at the first port 112 that can overcome the biasing force. With this configuration, the maximum pressure setting of the valve 100 can be adjusted via the manual adjustment actuator 168 without disassembling the valve 100. As an example for illustration, the adjustment piston 174 can have a stroke of about 0.15 inches, which corresponds to a maximum pressure setting range between 0 psi and 5000 psi.

As an example for illustration, the spring rate $k_1$ can be about 80 lbf/in and the spring rate $k_2$ can be about 150 lbf/in, and if the adjustment piston 174 moves a distance of 0.15 inches, then the solenoid actuator sleeve 146 can move axially in the distal direction about 0.052 inches. In this position, the biasing force can be about 6.9 pounds leading to a pressure setting of 5000 psi when the diameter of the pilot seat 136 is about 0.042 inches.

As such, the manual adjustment actuator 168 sets a maximum pressure setting of the valve 100 once positions of the adjustment screw 184 and the adjustment piston 174 are set. During operation of the valve, the pressure setting of the valve 100 can be decreased from such maximum pressure setting by actuating the valve 100 via an electrical actuation signal to the solenoid coil 141.

When an electrical current is provided through the windings of the solenoid coil 141, a magnetic field is generated. The pole piece 203 directs the magnetic field through the airgap 152 toward the armature 144, which is movable and is attracted toward the pole piece 203. In other words, when an electrical current is applied to the solenoid coil 141, the generated magnetic field forms a north and south pole in the pole piece 203 and the armature 144, and therefore the pole piece 203 and the armature 144 are attracted to each other. Because the pole piece 203 is fixed and the armature 144 is movable, the armature 144 can traverse the airgap 152 toward the pole piece 203, and the airgap 152 is reduced in size. As such, a solenoid force is applied on the armature 144, where the solenoid force is a pulling force that tends to pull the armature 144 in the proximal direction. The solenoid force is proportional to a magnitude of the electrical command or signal (e.g., magnitude of electrical current or voltage applied to the solenoid coil 141).

The solenoid force applied to the armature 144 is also applied to the solenoid actuator sleeve 146, which is coupled to the armature 144 as described above. The solenoid actuator sleeve 146 in turn applies a compressive force in the proximal direction on the first setting spring 156, while allowing the second setting spring 160 to be relaxed (e.g., decompressed). As a result, the effective biasing force that the setting springs 156, 160 apply to the pilot spring cap 162 and the pilot check member 138 in the distal direction is reduced, and the pressure setting of the valve 100 is thus reduced.

Such reduction in the pressure setting when the solenoid coil 141 is energized can take place whether the valve 100 is open or closed and whether the armature 144 moves or not. Under some operating conditions, when the solenoid coil 141 is energized, and because the pole piece 203 is fixed and the armature 144 is movable, the armature 144 is pulled in the proximal direction and traverses the airgap 152 toward the pole piece 203. The armature 144 moves while the pin 170 does not move therewith. As the armature 144 is pulled in the proximal direction, the armature 144 causes the solenoid actuator sleeve 146 coupled thereto to move in the proximal direction as well. As the solenoid actuator sleeve 146 moves in the proximal direction, the spring cap 172 remains stationary as it is coupled to the pin 170, which does not move with the armature 144.

As a result of the motion of the solenoid actuator sleeve 146 in the proximal direction, the first setting spring 156 is compressed in the proximal direction and the second setting spring 160 is relaxed and is elongated. Thus, the effective biasing force that the setting springs 156, 160 apply to the pilot check member 138 via the pilot spring cap 162 in the distal direction is reduced. For example, the biasing force acting on the pilot check member 138 can be determined as the effective spring force of the setting springs 156, 160 minus the solenoid force applied by the armature 144 on the solenoid actuator sleeve 146 in the proximal direction. As a result of the reduction in the force applied to the pilot check member 138, the pressure setting of the valve 100 is reduced. Thus, the force that the pressurized fluid received at the first port 112 needs to apply on the pilot check member 138 to open the valve 100 is reduced.

Similarly, under static conditions (e.g., when the solenoid coil 141 but the armature 144 does not move), the solenoid force applied to the armature 144 is transferred to the solenoid actuator sleeve 146 and the first setting spring 156. As a result of the compressive force applied on the first setting spring 156 in the proximal direction and relaxation of the second setting spring 160, a reduction in the pressure setting of the valve 100 takes place despite absence of motion of the armature 144 or the solenoid actuator sleeve 146.

With this configuration, the pulling force (e.g., the solenoid force) of the armature 144 in the proximal direction assists the pressurized fluid received at the first port 112 in overcoming the force applied to the pilot check member 138 in the distal direction by the setting springs 156, 160. In other words, the force that the pressurized fluid received at the first port 112 needs to apply to the pilot check member 138 to cause it to be unseated and move axially in the proximal direction is reduced to a predetermined force value that is based on the solenoid force. The solenoid force in turn is based on the magnitude of the electrical current (e.g., magnitude of the signal) provided to the solenoid coil 141. As such, the pulling force (i.e., the solenoid force) resulting from sending a signal to the solenoid coil 141 effectively reduces the pressure setting of the valve 100, and thus a reduced pressure level at the first port 112 can cause the valve 100 to open.

The larger the magnitude of the electrical signal, the larger the solenoid force and the lower the pressure setting of the valve 100. As such, the pressure setting of the valve 100 is reduced in proportion to the increase in the magnitude of the electrical signal. In other words, the pressure setting of the valve 100 can be changed inversely proportional to the magnitude of the electrical signal.

Figure 4:
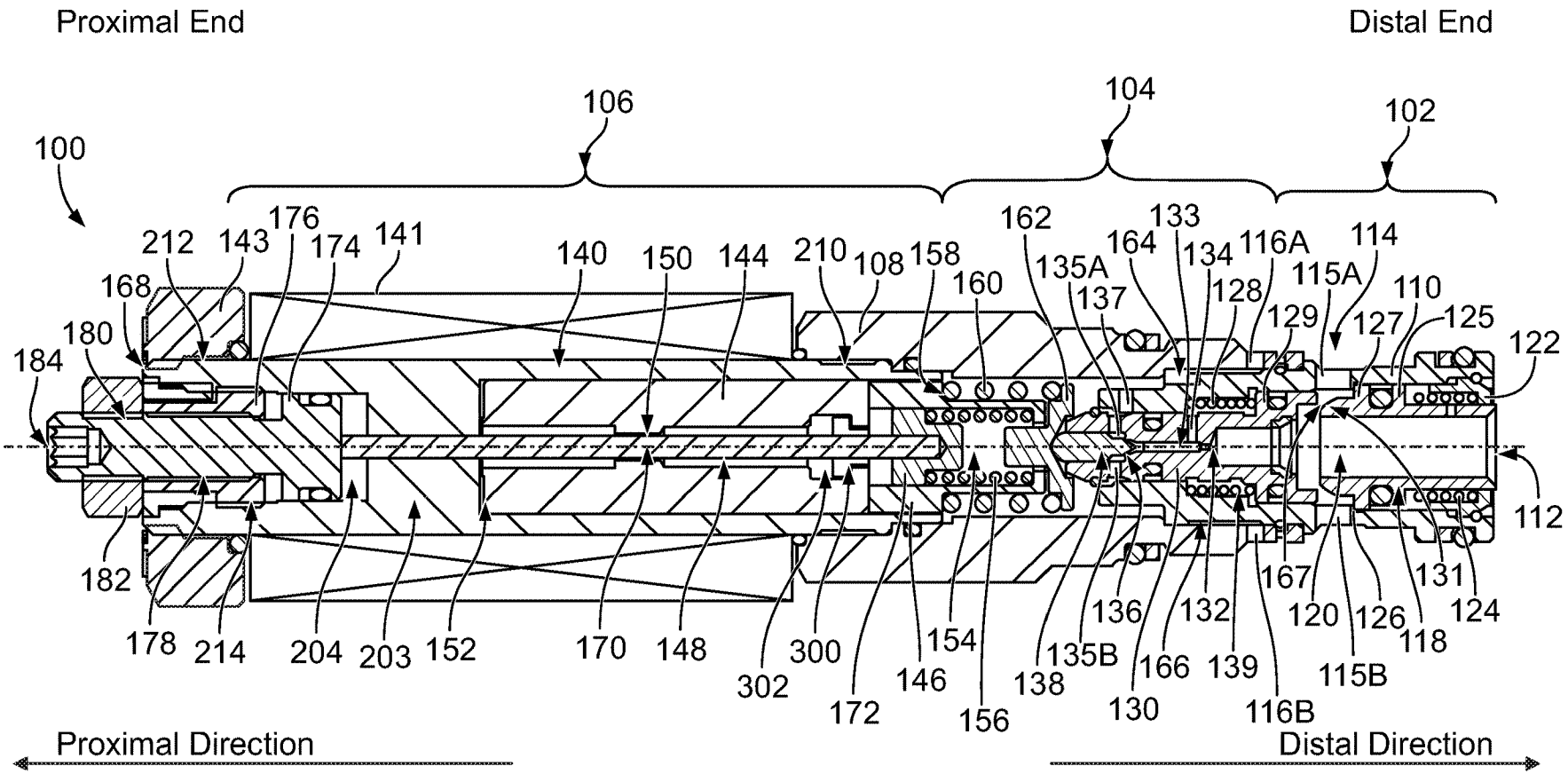
FIG. 4 illustrates the valve of FIG. 1 with a solenoid coil energized to an extent causing the valve to operate at a minimum pressure relief setting, in accordance with an example implementation.

The electrical signal can be increased in magnitude until the solenoid force reaches a particular magnitude that causes the valve 100 to have a minimum pressure setting. FIG. 4 illustrates the valve 100 with the solenoid coil 141 energized to an extent causing the valve 100 to operate at a minimum pressure setting, in accordance with an example implementation. When the solenoid force is sufficiently large (e.g., solenoid force of 12 lbf) the armature 144 and the solenoid actuator sleeve 146 move in the proximal direction compressing the first setting spring 156 and decompressing the second setting spring 160 to the extent shown in FIG. 4.

In this case, the second setting spring 160 can be substantially completely relaxed. This way, the biasing force applied to the pilot check member 138 can be minimal. Further, as the armature 144 moves in the proximal direction, the spring cap 172 in FIG. 4 remains displaced by the pin 170 compared to its position in FIG. 1 and thus the gap between the armature 144 and the spring cap 172 increases compared to FIG. 1. Further, the airgap 152 decreases as the armature 144 moves in the proximal direction.

Thus, although the manual adjustment actuator 168 can be set at a large pressure setting with the adjustment piston 174 displaced axially toward the pole piece 203, energizing the solenoid coil 141 with a sufficiently large electrical signal can reduce the pressure setting of the valve to a minimum setting (e.g., 100 psi). As an example for illustration, with the configuration of FIG. 4, if pressure level of fluid at the first port 112 and the main chamber 120 is about 300 psi, pressure level in the longitudinal channel 133 and the annular chamber 139 can be about 100 psi, and such 100 psi pressure level can be sufficient to unseat the pilot check member 138. As described above, as a result of the pilot check member 138 being unseated, a pilot flow is generated and the main piston 130 is also unseated to form the flow area 167. For example, the main piston 130 can move about 0.034 inches, and the main flow path from the first port 112 to the second port 114 via the main flow cross-holes 115A, 115B is opened.

The An electrical signal having a magnitude between a predetermined value (e.g., a value between zero and 20 milliamps) and the value causing the armature 144 to move to the position shown in FIG. 4 (e.g., a value of 80 milliamps) changes the pressure setting of the valve 100 to a value between the maximum pressure setting (e.g., 5000 psi) established by the manual adjustment actuator 168 and a minimum pressure setting (e.g., a setting of 100 psi).

In examples, the second setting spring 160 is configured to be stiffer (i.e., has a higher spring rate) than the first setting spring 156. For instance, the spring rate $k_1$ of the first setting spring 156 can be about 80 lbf/in, whereas the spring rate $k_2$ of the second setting spring 160 can be about 150 lbf/in. In this example, the equivalent spring rate $k_{eq}$ can be calculated as $$k_{eq} = \frac{k_1 k_2}{k_1 + k_2} = 52.2 \text{ lbf/inch.}$$

Thus, the equivalent spring rate $k_{eq}$ is less than either $k_1$ or $k_2$.

With this configuration, the second setting spring 160 effectively decouples or isolates the pilot check member 138 from the dynamics of the armature 144 and the solenoid actuator sleeve 146. The armature 144 can be subjected to friction forces and can be heavier in weight compared to the pilot check member 138. Thus, when an electrical current is applied to the solenoid coil 141 to move the armature 144, the armature 144 can be subjected to friction forces, stickiness, or oscillations. Such friction, stickiness, or oscillations can be transferred to the solenoid actuator sleeve 146 and the first setting spring 156. However, the presence of the second setting spring 160 may decouple or isolate the pilot check member 138 from such dynamics (e.g., friction, stickiness, or oscillations) of the armature 144. This way, the pilot check member 138 is less sensitive to dynamics of the armature 144. As a result, stability of the valve 100 may be enhanced.

Further, the configuration of the valve 100 having the setting springs 156, 160 in series causes an equivalent softer spring having the equivalent spring rate $k_{eq}$ being less than either $k_1$ or $k_2$ to act on the pilot check member 138. This way, high resolution or high accuracy axial displacements of the pilot check member 138 are achievable, while reducing the effects of the dynamics of the armature 144 on the pilot check member 138. For instance, displacements of about 0.001 inches of the pilot check member 138 can be achieved, and thus small amounts of pilot flow variation and correspondingly small amounts of main flow variation can be achieved.

Further, the pilot check member 138 is small in mass. As such, the effective mass of the pilot stage 104 (e.g., the combined mass of the pilot check member 138, the pilot spring cap 162, and the second setting spring 160) can be small (e.g., 2 grams). If the armature 144 is coupled rigidly or directly to the pilot check member 138, without the second setting spring 160 being disposed therebetween, then the effective mass of the pilot stage can be much larger (e.g., 25 grams), which is undesirable.

The combination of the pilot check member 138 being light (small in mass) and an equivalent spring that is softer than either of the setting springs 156, 160 causes the pilot check member 138 to have fast response time (e.g., high frequency response). A fast response time indicates that the pilot check member 138 can move to a commanded position off the pilot seat 136 in a shorter amount of time compared to a configuration where one stiff setting spring and a larger mass pilot check member are used.

Further, beneficially, with the configuration of the valve 100, neither of the setting springs 156, 160 is positioned within the pole piece 203, and therefore the presence of the setting springs 156, 160 does not limit the size of the pole piece 203 or limit the solenoid force that can be achieved when the solenoid coil 141 is energized. Thus, with the configuration of the valve 100, larger solenoid forces can be achieved. Larger solenoid forces are beneficial because wider or larger pressure setting ranges can be achieved. Further, with large spring rates of the setting springs 156, 160 and large solenoid forces, the effect of friction (between the armature 144 and the solenoid tube 140 and between the pilot check member 138 and the main piston 130) on hysteresis can be reduced. Further, larger solenoid forces can allow for larger seat diameters of the pilot seat 136, thereby allowing for a large pilot flow if desired, and thus allowing for larger main flows.

Further, the pressure setting of the valve 100 can be varied by varying the command signal to the solenoid coil 141. As such, in contrast to conventional counterbalance valves, no external pilot signal is required to cooperate with the fluid at the first port 112 to open the valve 100. Rather, the pressure setting of the valve 100 is varied electrically. Thus, the effects of a pilot ratio on stability of the counterbalance valve can be avoided with the use of the valve 100.

In example hydraulic systems, a counterbalance valve is configured to restrict fluid flow from a first port to a second port, while acting as a free-flow check valve allowing free flow from the second port to the first port. This way, while restricting fluid exiting an actuator, the counterbalance valve can allow free meter-in flow into the actuator. The valve 100 is configured to allow free flow from the second port 114 to the first port 112 to perform the operation of a free-flow check valve. The term "free flow" is used herein to indicate that fluid flow can occur from the second port 114 to the first port 112 with minimal pressure drop (e.g., 25 psi) and without a commanded signal to the solenoid coil 141.

Figure 5:
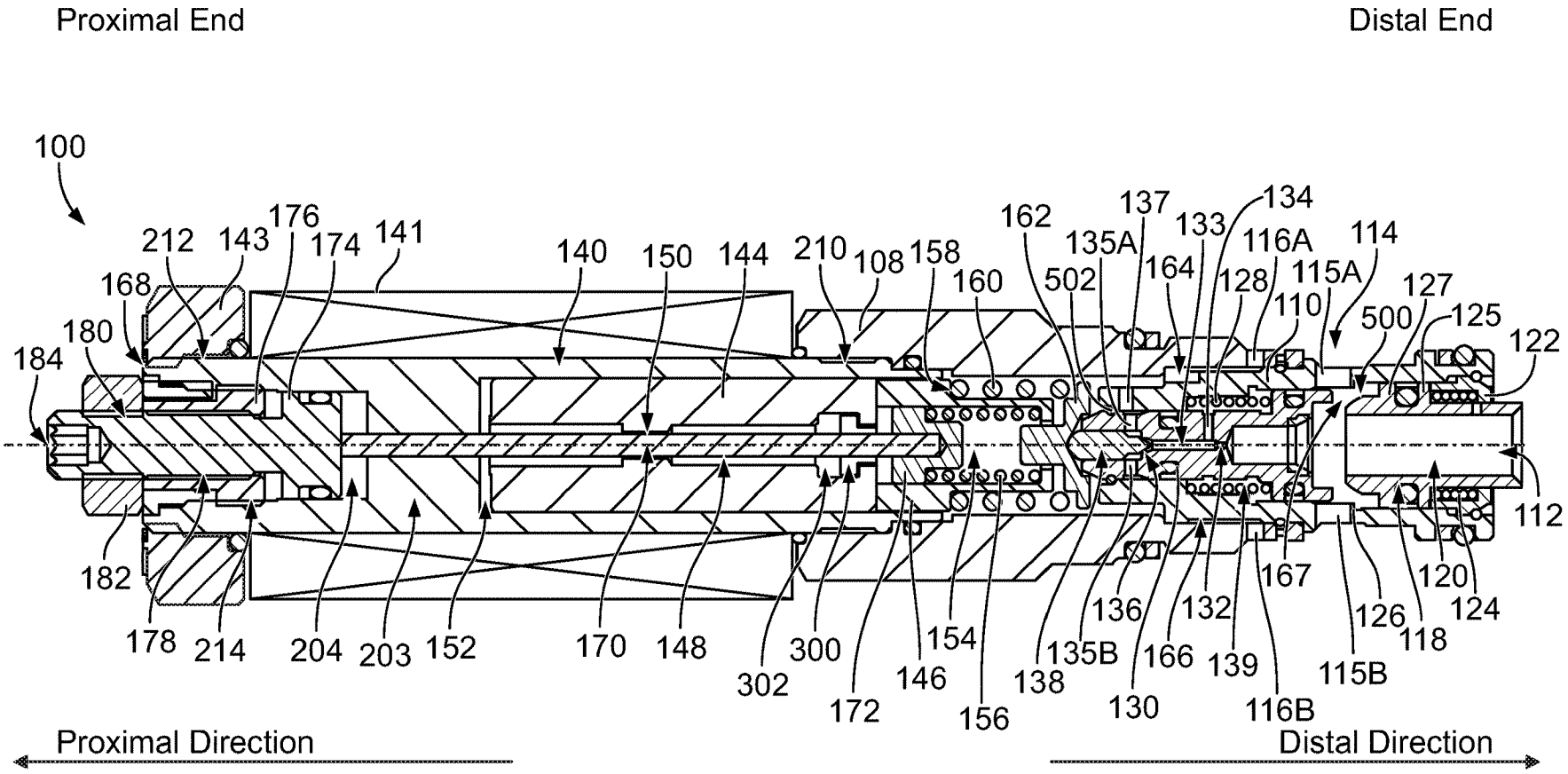
FIG. 5 illustrates operation of the valve of FIG. 1 to allow free flow from a second port to a first port, in accordance with an example implementation

FIG. 5 illustrates operation of the valve 100 to allow free flow from the second port 114 to the first port 112, in accordance with an example implementation. In this mode of operation, pressurized fluid is received at the second port 114 (e.g., from a directional control valve providing meter-in flow to the actuator), and the valve 100 allows fluid to flow freely from the second port 114 to the first port 112.

The pressurized fluid received at the second port 114 flows through the main flow cross-holes 115A, 115B to an annular space 500 between the interior peripheral surface of the main sleeve 110 and the exterior peripheral surface of the reverse flow piston 118. The pressurized fluid then applies a force on the reverse flow piston 118, thereby pushing the reverse flow piston 118 in the distal direction against the reverse flow check spring 124. FIG. 5 depicts the reverse flow piston 118 moved or displaced in the distal direction (to the right in FIG. 5) relative to its position in FIG. 1, such that the shoulder 127 moves away in the distal direction from the protrusion 126.

As a result of displacement of the reverse flow piston 118, the pressurized fluid received at the second port 114 flows freely, without sending a signal to the solenoid coil 141, through the main flow cross-holes 115A, 115B, then the flow area 167, through an inner chamber or cavity of the reverse flow piston 118 to the first port 112. From the first port 112, the pressurized fluid flows to the actuator.

As depicted in FIG. 5, the valve 100 further includes a wire ring 502 disposed in an annular groove disposed in an exterior peripheral surface of the main piston 130. The wire ring 502 protrudes radially outward, such that the wire ring 502 engages or interacts with the interior surface of the main sleeve 110 to prevent the main piston 130 from following the reverse flow piston 118 when the reverse flow piston 118 moves in the distal direction.

Figure 6:
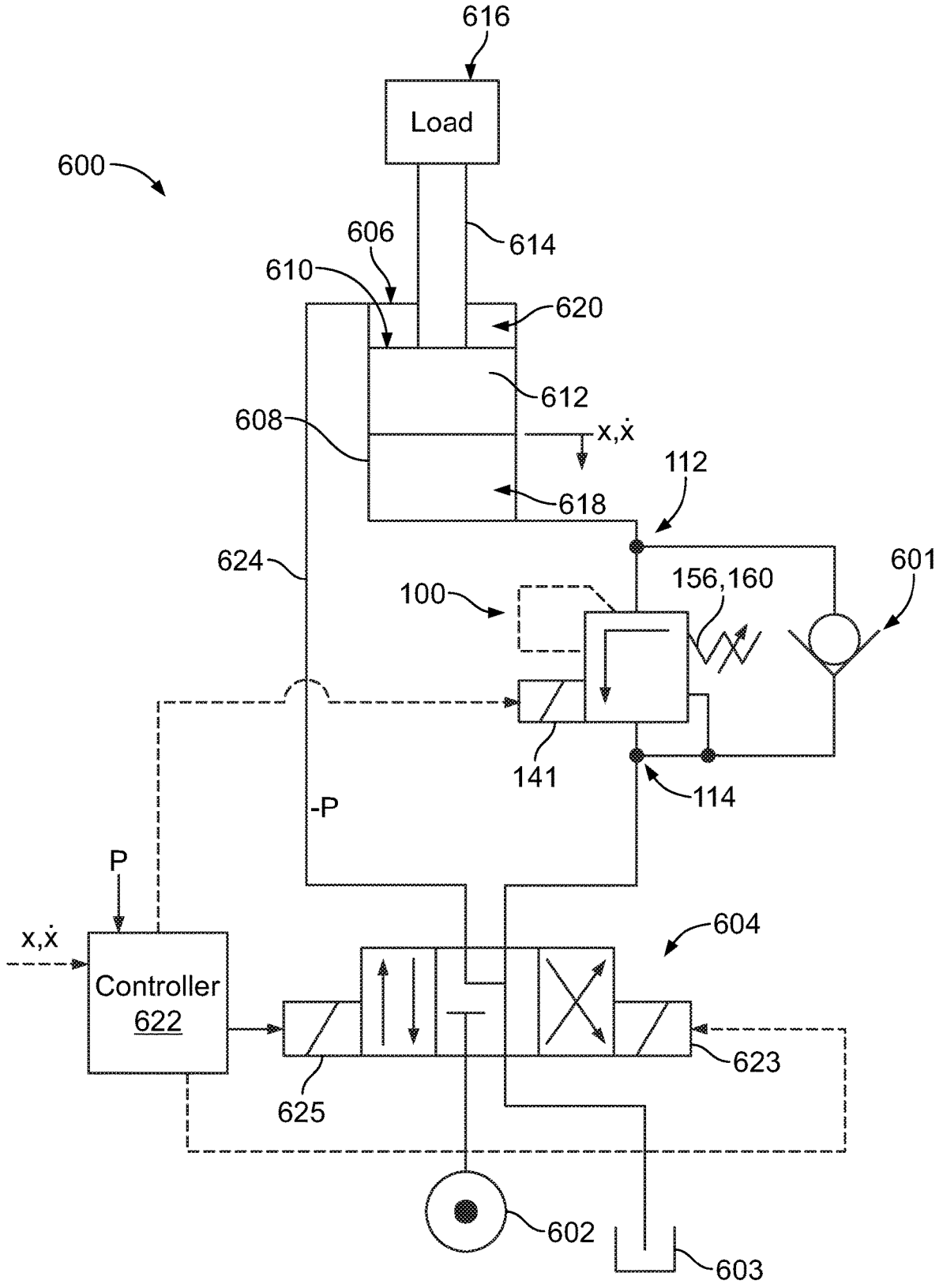
FIG. 6 illustrates a hydraulic system using the valve illustrated in FIG. 1, in accordance with an example implementation.

The valve 100 can be used as a counterbalance valve in various hydraulic systems. FIG. 6 illustrates a hydraulic system 600 using the valve 100, in accordance with an example implementation. The valve 100 is depicted symbolically in FIG. 6. In FIG. 6, the setting springs 156, 160 are represented by one equivalent or effective spring. Further, the valve 100 is depicted as having a check valve 601 that represents free flow operation from the second port 114 to the first port as described above with respect to FIG. 5.

The hydraulic system 600 includes a source 602 of fluid. The source 602 of fluid can, for example, be a pump configured to provide fluid to the first port 112 of the valve 100. Such pump can be a fixed displacement pump, a variable displacement pump, or a load-sensing variable displacement pump, as examples. Additionally or alternatively, the source 602 of fluid can be an accumulator or another component (e.g., a valve) of the hydraulic system 600.

The hydraulic system 600 also includes a reservoir or tank 603 of fluid that can store fluid at a low pressure (e.g., 0-70 psi). The source 602 of fluid can be configured to receive fluid from the tank 603, pressurize the fluid, then provide pressurized fluid to a directional control valve 604.

The directional control valve 604 can be, for example, an on/off four-way, three-position directional valve. The directional control valve 604 is configured to direct fluid flow to and from an actuator 606. The actuator 606 includes a cylinder 608 and a piston 610 slidably accommodated in the cylinder 608. The piston 610 includes a piston head 612 and a rod 614 extending from the piston head 612 along a central longitudinal axis direction of the cylinder 608. The rod 614 is coupled to a load 616 and the piston head 612 divides the inside space of the cylinder 608 into a first chamber 618 and a second chamber 620.

As shown in FIG. 6, the first port 112 of the valve 100 is fluidly coupled to the first chamber 618 of the actuator 606. The second port 114 of the valve 100 is fluidly coupled to the directional control valve 604.

The hydraulic system 600 can further include a controller 622. The controller 622 can include one or more processors or microprocessors and may include data storage (e.g., memory, transitory computer-readable medium, non-transitory computer-readable medium, etc.). The data storage may have stored thereon instructions that, when executed by the one or more processors of the controller 622, cause the controller 622 to perform operations described herein. Signal lines to and from the controller 622 are depicted as dashed lines in FIG. 6.

The controller 622 can receive input or input information comprising sensor information via signals from various sensors or input devices in the hydraulic system 600, and in response provide electrical signals to various components of the hydraulic system 600. For example, the controller 622 can receive from a position sensor and/or a velocity sensor coupled to the piston 610 information indicative of the position x and velocity $\dot{x}$ of the piston 610. Additionally or alternatively, the controller 622 can receive from pressure sensors coupled to the first chamber 618 and/or the second chamber 620 information indicative of pressure level p of fluid in the chambers 618, 620 or indicative of a magnitude of the load 616. The controller 622 can also receive an input (e.g., from a joystick of a machine) indicative of a commanded or desired speed for the piston 610. The controller 622 can then provide signals to the directional control valve 604 and the valve 100 to move the piston 610 at a desired commanded speed in a controlled manner.

For example, to extend the piston 610 (i.e., move the piston 610 up in FIG. 6), the controller 622 can send a command signal to a first solenoid coil 623 of the directional control valve 604 to actuate it and operate it in a first state. As a result, pressurized fluid is provided from the source 602 through the directional control valve 604, then through the check valve 601 of the valve 100 to the first chamber 618. As the piston 610 extends, fluid forced out of the second chamber 620 flows through a hydraulic line 624 and the directional control valve 604 to the tank 603.

To retract the piston 610, the controller 622 can send a command signal to a second solenoid coil 625 of the directional control valve 604 to actuate it and operate it in a second state pressurized fluid is provided from the source 602 through the directional control valve 604 and the hydraulic line 624 to the second chamber 620. As the piston 610 retracts, fluid in the first chamber 618 is forced out of the first chamber 618 to the first port 112 of the valve 100.

In contrast with conventional counterbalance valves, no pilot signal is tapped from the hydraulic line 624 to actuate the valve 100 and allow fluid flow therethrough. Rather, the valve 100 is controlled via a command signal to the solenoid coil 141 to reduce the pressure setting to a value that is determined by the controller 622 based on parameters such as the parameters x, $\dot{x}$, and p described above.

Thus, the controller 622 sends a command signal to the valve 100 to open the valve 100 when pressure level at the first port 112 (which is substantially the pressure level at the first chamber 618 of the actuator 606) reaches the pressure setting of the valve 100 determined by the command signal. Fluid can then flow through the valve 100, then through the directional control valve 604 to the tank 603. As the conditions of the hydraulic system change (e.g., as the load 616 changes in magnitude, the commanded speed of the piston 610 changes, or pressure level in the first chamber 618 or the second chamber 620 changes), the valve 100 can adjust the magnitude of the command signal to the solenoid coil 141 to change the pressure setting of the valve 100 accordingly. By controlling the pressure level in the first chamber 618, the hydraulic system 600 can be operated more efficiently (e.g., by reducing the pressure level in the first chamber 618 as the piston 610 moves).

The actuator 606 of the hydraulic system is a double-acting cylinder, where the cylinder 608 has the chambers 618, 620 that can be supplied with hydraulic fluid for both the retraction and extension of the piston 610. A double-acting cylinder can be used where an external force is not available to retract the piston or it can be used where high force is required in both directions of travel.

However, in some applications, a single-acting cylinder can be used. A single-acting cylinder is a cylinder in which the hydraulic fluid acts on one side of the piston. The single-acting cylinder relies on the load, springs, other cylinders, or the momentum of a load, to push the piston back in the other direction. In these applications, the valve 100 can be combined with a two-position, three-way valve to control motion of the piston of the single-acting cylinder.

Figure 7:
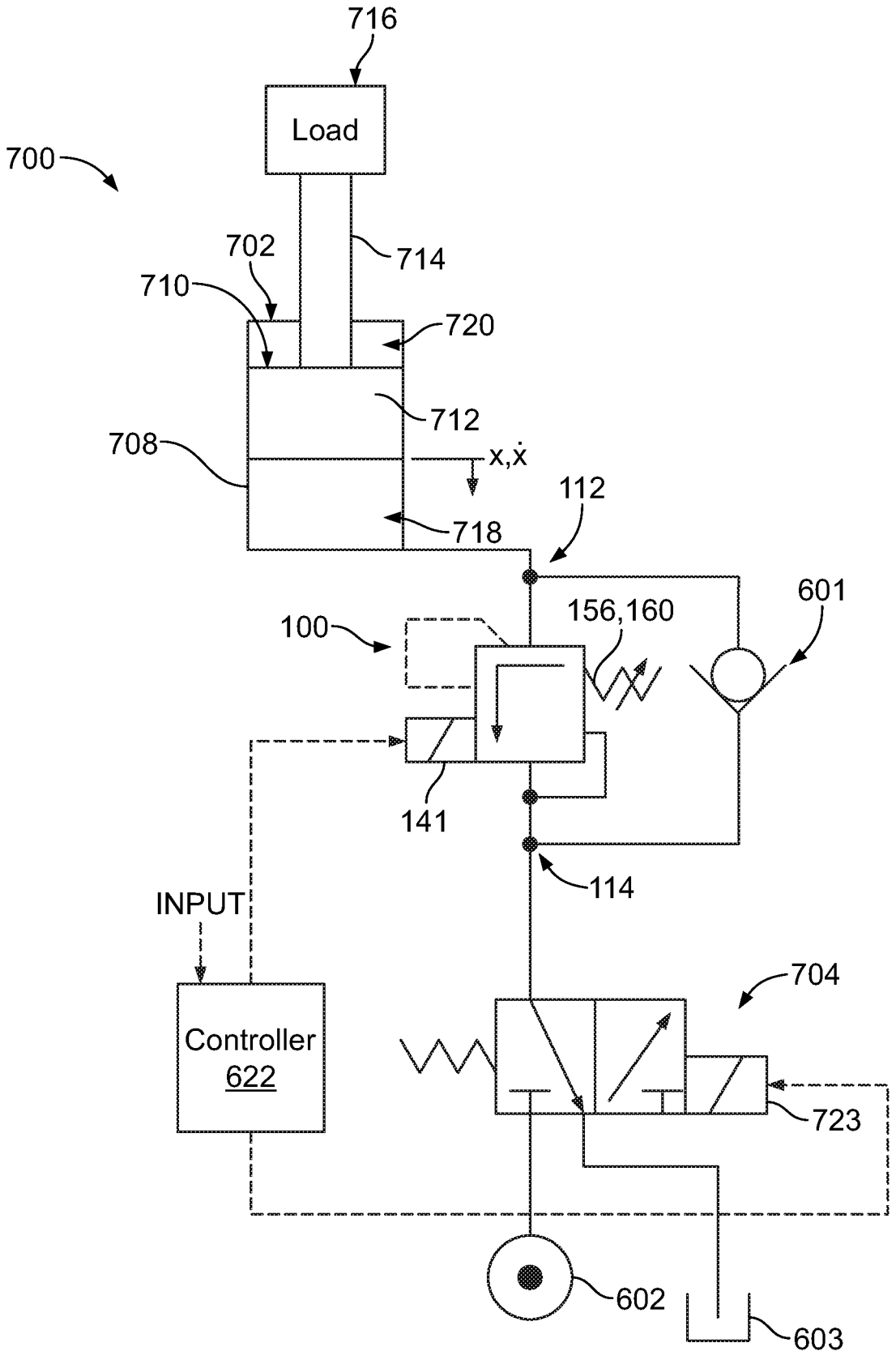
FIG. 7 illustrates a hydraulic system using the valve illustrated in FIG. 1 to control motion of an actuator configured as a single-acting cylinder, in accordance with an example implementation.

FIG. 7 illustrates a hydraulic system 700 using the valve 100 to control motion of an actuator 702 configured as a single-acting cylinder, in accordance with an example implementation. Similar components in FIGS. 6 and 7 are assigned the same reference numbers.

The hydraulic system 700 includes a directional control valve 704 that can be, for example, an on/off three-way, two-position directional valve. The directional control valve 704 is configured to direct fluid flow to and from the actuator 702. The actuator 702 includes a cylinder 708 and a piston 710 slidably accommodated in the cylinder 708. The piston 710 includes a piston head 712 and a rod 714 extending from the piston head 712 along a central longitudinal axis direction of the cylinder 708. The rod 714 is coupled to a load 716. The piston head 712 divides the inside of the cylinder 708 into a first chamber 718 and a second chamber 720.

As shown in FIG. 7, the first port 112 of the valve 100 is fluidly coupled to the first chamber 718 of the actuator 702. In an example, the second chamber 720 can be vented to the atmosphere. In another example, the second chamber 720 can house a spring that biases the piston 710 toward a retracted position and facilitates retraction of the piston 710. The second port 114 of the valve 100 is fluidly coupled to the directional control valve 704.

The controller 622 can receive input or input information comprising sensor information via signals from various sensors or input devices in the hydraulic system 700, and in response provide electrical signals to various components of the hydraulic system 700. For example, the controller 622 can receive from a position sensor and/or a velocity sensor coupled to the piston 710 information indicative of position x and velocity $\dot{x}$ of the piston 710. Additionally or alternatively, the controller 622 can receive from pressure sensors coupled to the first chamber 718 information indicative of pressure level p of the first chamber 718. The controller 622 can also receive an input (e.g., from a joystick of a machine) indicative of a commanded or desired speed for the piston 710. The controller 622 can then provide signals to the directional control valve 704 and the valve 100 to move the piston 710 in a controlled manner.

For example, to extend the piston 710 (i.e., move it up in FIG. 7), the controller 622 can send a command signal to a solenoid coil 723 of the directional control valve 704 to actuate it and operate it in a first state. As a result, pressurized fluid is provided from the source 602 through the directional control valve 704, then through the check valve 601 of the valve 100 to the first chamber 718.

To retract the piston 710, no signal is provided to the solenoid coil 723; rather, the directional control valve 704 operates in a second state (i.e., an unactuated state) to fluidly couple the second port 114 of the valve 100 to the tank 603. As the piston 710 retracts under the weight of the load 716 or via a spring, fluid in the first chamber 718 is forced out of the first chamber 718 to the first port 112 of the valve 100.

The controller 622 sends a command signal to the solenoid coil 141 of the valve 100 to open the valve 100 when pressure level at the first port 112 (which is substantially the pressure level at the first chamber 718 of the actuator 702) reaches the pressure setting of the valve 100 determined by the command signal. Fluid can then flow through the valve 100, then through the directional control valve 704 to the tank 603. As the conditions of the hydraulic system change (e.g., as the load 716 changes in magnitude, the commanded speed of the piston 710, or pressure level in the first chamber 718 changes), the valve 100 can adjust the magnitude of the command signal to the solenoid coil 141 to change the pressure setting of the valve 100 accordingly.

Figure 8:
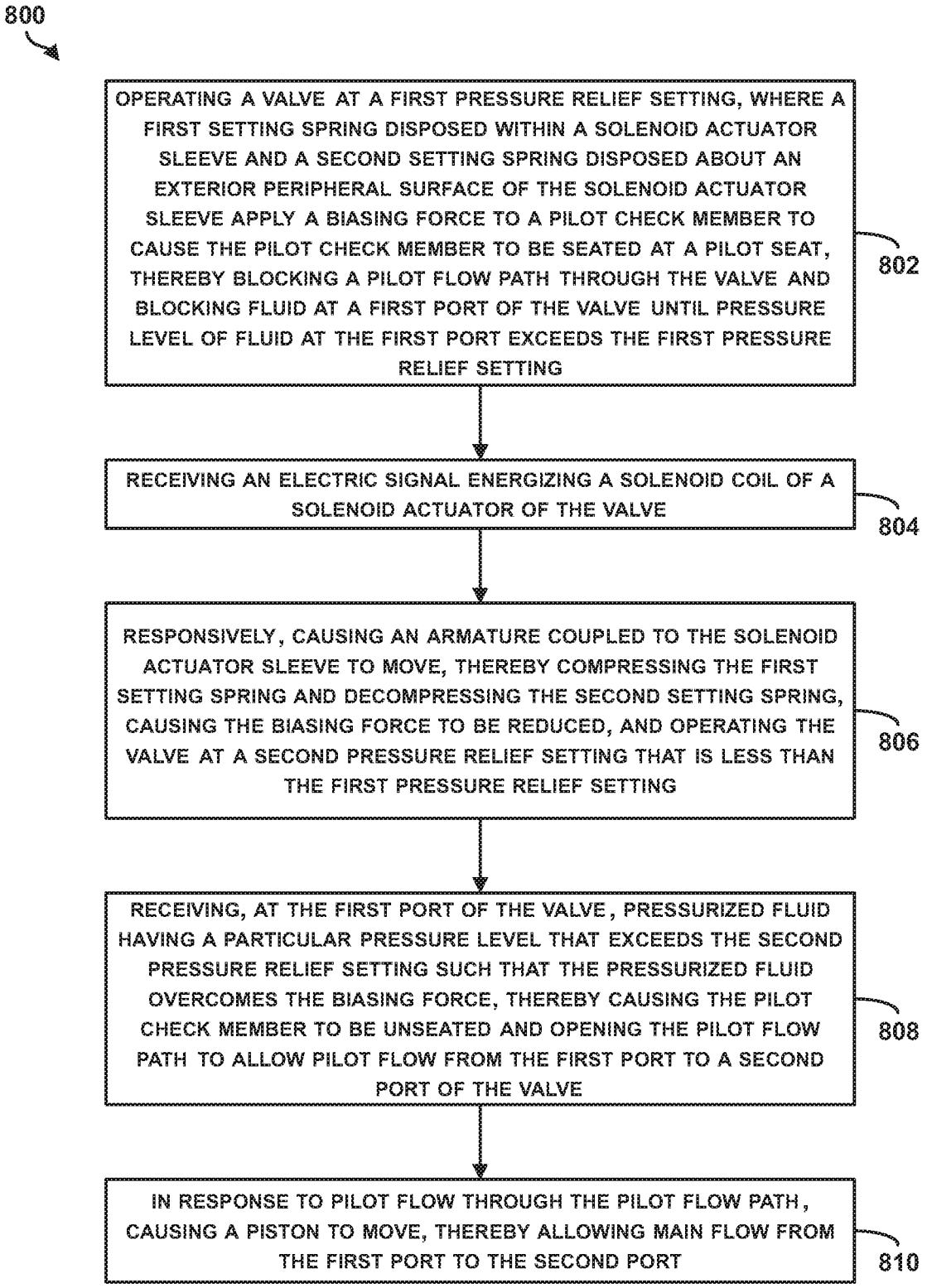
FIG. 8 is a flowchart of a method for operating a valve, in accordance with an example implementation.

FIG. 8 is a flowchart of a method 800 for operating a valve, in accordance with an example implementation. The method 800 shown in FIG. 8 presents an example of a method that can be used with the valve 100 shown throughout the Figures, for example. The method 800 may include one or more operations, functions, or actions as illustrated by one or more of blocks 802-810. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 802, the method 800 includes operating the valve 100 at a first pressure setting, where the first setting spring 156 disposed within the solenoid actuator sleeve 146 and the second setting spring 160 disposed about the exterior peripheral surface of the solenoid actuator sleeve 146 apply a biasing force to the pilot check member 138 to cause the pilot check member 138 to be seated at the pilot seat 136 formed by the main piston 130, thereby blocking a pilot flow path through the valve 100 and blocking fluid at the first port 112 of the valve 100 until pressure level of fluid at the first port 112 exceeds the first pressure setting.

At block 804, the method 800 includes receiving an electrical signal (e.g., from the controller 622) energizing the solenoid coil 141 of a solenoid actuator (e.g., the solenoid actuator 106) of the valve 100. The controller 622 can receive a request to modify or reduce the pressure setting of the valve 100. In response, the controller 622 sends the electrical signal to the solenoid coil 141 to energize it, or increase a magnitude of the electrical signal provided to the solenoid coil 141.

At block 806, the method 800 includes, responsively, causing the armature 144 coupled to the solenoid actuator sleeve 146 to move, thereby compressing the first setting spring 156 and decompressing the second setting spring 160, causing the biasing force to be reduced, and operating the valve 100 at a second pressure setting that is less than the first pressure setting.

At block 808, the method 800 includes receiving, at the first port 112 of the valve 100, pressurized fluid having a particular pressure level that exceeds the second pressure setting such that the pressurized fluid overcomes the biasing force, thereby causing the pilot check member 138 to be unseated and opening the pilot flow path to allow pilot flow from the first port 112 to the second port 114 of the valve 100.

At block 810, the method 800 includes, in response to pilot flow through the pilot flow path, causing the main piston 130 to move, thereby allowing main flow from the first port 112 to the second port 114.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

The By the term "substantially" or "about" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A valve comprising:

a main piston comprising: (i) a channel that is fluidly coupled to a first port of the valve, (ii) a pilot seat, and (iii) one or more cross-holes fluidly coupled to a second port of the valve;

a reverse flow piston disposed at the first port of the valve and configured to move axially within the valve;

a reverse flow check spring that biases the reverse flow piston toward the main piston, such that the reverse flow piston operates as a piston seat for the main piston when the valve is closed;

a pilot check member configured to be seated at the pilot seat when the valve is closed to block fluid flow from the channel to the one or more cross-holes of the main piston, wherein the pilot check member is configured to be subjected to a fluid force of fluid in the channel of the main piston acting on the pilot check member in a proximal direction;

a solenoid actuator sleeve comprising a chamber therein;

a first setting spring disposed in the chamber within the solenoid actuator sleeve and configured to bias the solenoid actuator sleeve in a distal direction; and a second setting spring disposed about an exterior peripheral surface of the solenoid actuator sleeve and configured to bias the pilot check member in the distal direction, such that the first setting spring and the second setting spring cooperate to apply a biasing force in the distal direction on the pilot check member toward the pilot seat against the fluid force.

2. The valve of claim 1, wherein the solenoid actuator sleeve comprises a shoulder on the exterior peripheral surface of the solenoid actuator sleeve, and wherein a proximal end of the second setting spring rests against the shoulder, whereas a distal end of the second setting spring biases the pilot check member in the distal direction.

3. The valve of claim 2, further comprising:

a pilot spring cap disposed between the solenoid actuator sleeve and the pilot check member, wherein a distal end of the pilot spring cap contacts the pilot check member, and wherein the distal end of the second setting spring contacts a proximal end of the pilot spring cap, such that the second setting spring biases the pilot check member in the distal direction via the pilot spring cap.

4. The valve of claim 1, wherein as pressure level of fluid received at the first port of the valve exceeds a particular pressure level based on respective spring rates of the first setting spring and the second setting spring, the fluid force overcomes the biasing force of the first setting spring and the second setting spring on the pilot check member, thereby causing the pilot check member to be unseated and enabling generation of a pilot flow from the first port to the second port via a pilot flow path formed through the channel and the one or more cross-holes of the main piston.

5. The valve of claim 1, wherein when fluid is received at the second port, the fluid applies a force on the reverse flow piston against the reverse flow check spring causing the reverse flow piston to move axially away from the main piston, thereby allowing fluid flow from the second port to the first port.

6. The valve of claim 1, further comprising:

a housing having a longitudinal cylindrical cavity therein and having one or more cross-holes disposed in an exterior peripheral surface of the housing; and a main sleeve disposed, at least partially, in the longitudinal cylindrical cavity of the housing, wherein the main sleeve includes the first port at a distal end of the main sleeve and includes one or more cross-holes disposed on an exterior peripheral surface of the main sleeve, wherein the one or more cross-holes of the housing and the one or more cross-holes of the main sleeve form the second port.

7. The valve of claim 6, wherein the main piston and the reverse flow piston are disposed within the main sleeve and configured to be axially movable therein, wherein a main chamber is formed within the main sleeve and comprises at least a portion of respective interior spaces of the main piston and the reverse flow piston, and wherein the main chamber is fluidly coupled to the first port and the channel of the main piston.

8. The valve of claim 7, wherein as pressure level of fluid received at the first port of the valve exceeds a particular pressure level based on respective spring rates of the first setting spring and the second setting spring, the fluid force overcomes the biasing force of the first setting spring and the second setting spring on the pilot check member, thereby causing the pilot check member to be unseated and enabling generation of a pilot flow from the first port to the second port via a pilot flow path, wherein the pilot flow path comprises: the main chamber, the channel of the main piston, the one or more cross-holes of the main piston, and wherein generation of the pilot flow causes the main piston to move axially away from the piston seat to open a main flow path from the first port to the second port.

9. The valve of claim 8, wherein the pilot flow path further comprises (i) a longitudinal through-hole formed in the main piston, (ii) an annular groove formed on an exterior peripheral surface of the main sleeve, and (iii) the one or more cross-holes of the housing.

10. The valve of claim 1, further comprising:

a solenoid actuator comprising a solenoid coil, a pole piece, and an armature that is mechanically coupled to the solenoid actuator sleeve, such that when the solenoid coil is energized, the armature and the solenoid actuator sleeve coupled thereto move axially in the proximal direction toward the pole piece, thereby compressing the first setting spring and decompressing the second setting spring and reducing the biasing force on the pilot check member.

11. The valve of claim 10, wherein the solenoid actuator further comprises a solenoid tube, and wherein the solenoid tube comprises: (i) a cylindrical body, (ii) a first chamber defined within the cylindrical body and configured to receive the armature of the solenoid actuator therein, and (iii) a second chamber defined within the cylindrical body, wherein the pole piece is formed as a protrusion within the cylindrical body, wherein the pole piece is disposed between the first chamber and the second chamber, and wherein the pole piece defines a respective channel therethrough, such that the respective channel of the pole piece fluidly couples the first chamber to the second chamber.

12. The valve of claim 11, further comprising:

a manual adjustment actuator having: (i) an adjustment piston disposed, at least partially, in the second chamber of the solenoid tube, (ii) a pin disposed through the respective channel of the pole piece and through the armature, wherein a proximal end of the pin contacts the adjustment piston and a distal end of the pin is coupled to a spring cap against which a proximal end of the first setting spring rests, such that axial motion of the adjustment piston causes the pin and the spring cap coupled thereto to move axially, thereby adjusting the biasing force on the pilot check member.

13. A hydraulic system comprising:

a tank;

a hydraulic actuator having a chamber therein; and a valve having a first port fluidly coupled to the chamber of the hydraulic actuator, and a second port configured to be fluidly coupled to the tank, wherein the valve comprises:

a main piston comprising: (i) a channel that is fluidly coupled to the first port of the valve, (ii) a pilot seat, and (iii) one or more cross-holes fluidly coupled to the second port of the valve, a reverse flow piston disposed at the first port of the valve and configured to move axially within the valve, a reverse flow check spring that biases the reverse flow piston toward the main piston, such that the reverse flow piston operates as a piston seat for the main piston when the valve is closed, a pilot check member configured to be seated at the pilot seat when the valve is closed to block fluid flow from the channel to the one or more cross-holes of the main piston, wherein the pilot check member is configured to be subjected to a fluid force of fluid in the channel of the main piston acting on the pilot check member in a proximal direction, a solenoid actuator sleeve, a first setting spring disposed within the solenoid actuator sleeve and configured to bias the solenoid actuator sleeve in a distal direction, and a second setting spring disposed about an exterior peripheral surface of the solenoid actuator sleeve and configured to bias the pilot check member in the distal direction, such that the first setting spring and the second setting spring cooperate to apply a biasing force in the distal direction on the pilot check member toward the pilot seat against the fluid force.

14. The hydraulic system of claim 13, wherein the solenoid actuator sleeve of the valve comprises a shoulder on the exterior peripheral surface of the solenoid actuator sleeve, and wherein a proximal end of the second setting spring rests against the shoulder, whereas a distal end of the second setting spring biases the pilot check member in the distal direction.

15. The hydraulic system of claim 13, wherein the valve further comprises:

a housing having a longitudinal cylindrical cavity therein and having one or more cross-holes disposed in an exterior peripheral surface of the housing; and a main sleeve disposed, at least partially, in the longitudinal cylindrical cavity of the housing, wherein the main sleeve includes the first port at a distal end of the main sleeve and includes one or more cross-holes disposed on an exterior peripheral surface of the main sleeve, wherein the one or more cross-holes of the housing and the one or more cross-holes of the main sleeve form the second port, wherein the main piston and the reverse flow piston are disposed within the main sleeve and configured to be axially movable therein.

16. The hydraulic system of claim 13, further comprising:

a solenoid actuator comprising (i) a solenoid coil, (ii) a pole piece, (iii) an armature that is mechanically coupled to the solenoid actuator sleeve such that when the solenoid coil is energized, the armature and the solenoid actuator sleeve coupled thereto move axially in the proximal direction toward the pole piece, thereby compressing the first setting spring and decompressing the second setting spring and reducing the biasing force on the pilot check member, and (iv) a solenoid tube, wherein the solenoid tube comprises: (i) a cylindrical body, (ii) a first chamber defined within the cylindrical body and configured to receive the armature of the solenoid actuator therein, and (iii) a second chamber defined within the cylindrical body, wherein the pole piece is formed as a protrusion within the cylindrical body, wherein the pole piece is disposed between the first chamber and the second chamber, and wherein the pole piece defines a respective channel therethrough, such that the respective channel of the pole piece fluidly couples the first chamber to the second chamber; and a manual adjustment actuator having: (i) an adjustment piston disposed, at least partially, in the second chamber of the solenoid tube, (ii) a pin disposed through the respective channel of the pole piece and through the armature, wherein a proximal end of the pin contacts the adjustment piston and a distal end of the pin is coupled to a spring cap against which a proximal end of the first setting spring rests, such that axial motion of the adjustment piston causes the pin and the spring cap coupled thereto to move axially, thereby adjusting the biasing force on the pilot check member.

17. The hydraulic system of claim 13, wherein as pressure level of fluid received at the first port of the valve exceeds a particular pressure level based on respective spring rates of the first setting spring and the second setting spring, the fluid force overcomes the biasing force of the first setting spring and the second setting spring on the pilot check member, thereby causing the pilot check member to be unseated and enabling generation of a pilot flow from the first port to the second port via a pilot flow path formed through the channel and the one or more cross-holes of the main piston, and wherein generation of the pilot flow causes the main piston to move axially away from the piston seat to open a main flow path from the first port to the second port.

18. The hydraulic system of claim 13, wherein when pressurized fluid is received at the second port from a source of fluid, the pressurized fluid applies a force on the reverse flow piston against the reverse flow check spring causing the reverse flow piston to move axially away from the main piston, thereby allowing fluid flow from the second port to the first port.

19. A method comprising:

operating a valve at a first pressure setting, wherein a first setting spring disposed within a solenoid actuator sleeve and a second setting spring disposed about an exterior peripheral surface of the solenoid actuator sleeve apply a biasing force to a pilot check member to cause the pilot check member to be seated at a pilot seat formed by a main piston, thereby blocking a pilot flow path through the valve and blocking fluid at a first port of the valve until pressure level of fluid at the first port exceeds the first pressure setting;

receiving an electric signal energizing a solenoid coil of a solenoid actuator of the valve;

responsively, causing an armature coupled to the solenoid actuator sleeve to move, thereby compressing the first setting spring and decompressing the second setting spring, causing the biasing force to be reduced, and operating the valve at a second pressure setting that is less than the first pressure setting;

receiving, at the first port of the valve, pressurized fluid having a particular pressure level that exceeds the second pressure setting such that the pressurized fluid overcomes the biasing force, thereby causing the pilot check member to be unseated and opening the pilot flow path to allow pilot flow from the first port to a second port of the valve; and in response to pilot flow through the pilot flow path, causing the main piston to move, thereby allowing main flow from the first port to the second port.

20. The method of claim 19, wherein the valve comprises: (i) a reverse flow piston disposed at the first port of the valve and configured to move axially within the valve, and (ii) a reverse flow check spring that biases the reverse flow piston toward the main piston, such that the reverse flow piston operates as a piston seat for the main piston when the valve is closed, and wherein the method further comprises:

receiving, at the second port of the valve, pressurized fluid from a source of fluid; and responsively, applying a force on the reverse flow piston against the reverse flow check spring, thereby causing the reverse flow piston to move axially away from the main piston and allowing fluid flow from the second port to the first port.

* * * * *